United States Patent [19]

Rohret et al.

[11] Patent Number: 4,970,525

[45] Date of Patent: Nov. 13, 1990

[54] WAVEGUIDE ANTENNA WITH INCREASED GAIN

[75] Inventors: Paul J. Rohret, Des Plaines; Thomas A. Freeburg; Scott D. Munier, both of Arlington Heights, all of Ill.

[73] Assignee: Motorola, Inc., Schaumburg, Ill.

[21] Appl. No.: 357,939

[22] Filed: May 30, 1989

[51] Int. Cl.[5] ..... H01Q 19/14

[52] U.S. Cl. ..... 343/781 R; 343/785; 343/786

[58] Field of Search ..... 343/781 R, 781 P, 783, 343/772, 767, 779, 786, 785

[56] References Cited

U.S. PATENT DOCUMENTS

| | | | |
|---|---|---|---|
| 2,478,241 | 8/1949 | Chu | 343/781 R |
| 2,594,871 | 4/1952 | Chu et al. | 343/783 |
| 2,690,508 | 9/1954 | Cutler | 343/783 |
| 2,783,467 | 2/1957 | Gutton et al. | 343/785 |
| 2,822,542 | 2/1958 | Butterfield | 343/785 |
| 3,005,983 | 10/1961 | Chandler | 343/783 |
| 3,611,395 | 10/1971 | Carberry, Jr. | 343/786 |

FOREIGN PATENT DOCUMENTS

| | | | |
|---|---|---|---|
| 0013751 | 2/1977 | Japan | 343/781 R |
| 0200605 | 11/1983 | Japan | 343/781 R |

*Primary Examiner*—Rolf Hille
*Assistant Examiner*—Hoanganh Le
*Attorney, Agent, or Firm*—Wayne J. Egan; Anthony J. Sarli, Jr.

[57] ABSTRACT

An antenna is disclosed for increasing the gain of, or shaping the pattern of, a radiated radio frequency signal. The antenna includes a waveguide for directing the radio frequency signal or for receiving directively the radio signal, a first conductive reflector disposed beneath the waveguide and extending beyond the aperture of the waveguide for reflecting certain of the waves emanating from or entering the aperture of the waveguide, and a second reflector, which may be the mounting surface, disposed beneath the first reflector and extending beyond the first reflector for reflecting other of the waves emanating from or entering the aperture of the waveguide.

7 Claims, 1 Drawing Sheet

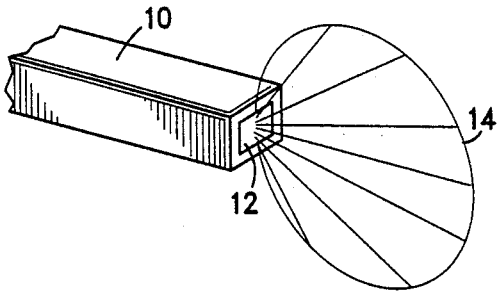
FIG. 1
FIG. 2
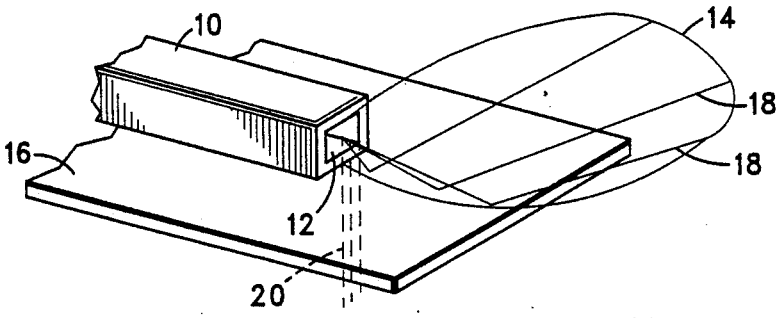
FIG. 3
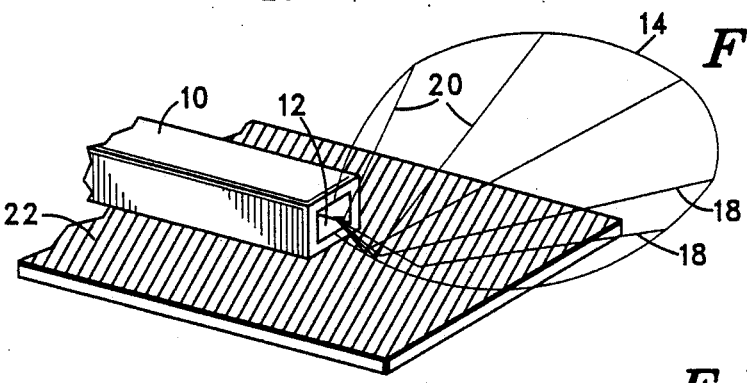
FIG. 4
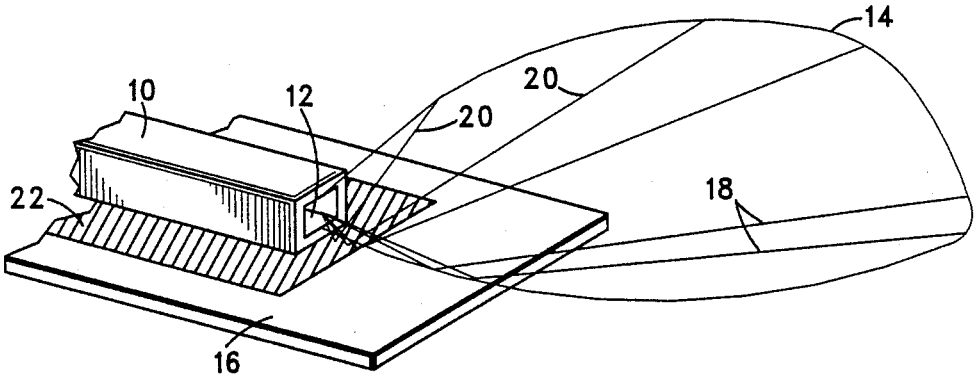

WAVEGUIDE ANTENNA WITH INCREASED GAIN

TECHNICAL FIELD

This invention relates to microwave antennas, and more particularly to waveguide antennas with improved gain or shaped coverage pattern.

DESCRIPTION OF THE PRIOR ART

In certain applications it is desirable to shape the coverage pattern of signals emanating from an antenna, either to provide coverage of specific areas, exclusion of coverage of specific areas, or to provide the same effective radiated power to a specific area with a physically smaller antenna.

The directivity and gain problems can be overcome through the use of horn antennas, but such antennas are expensive and their physical configuration makes them unsuitable for applications requiring a low profile, such as an antenna to be inconspicuously mounted on the ceiling of a room, or on a table top, or on the dashboard of an automobile, for example. Waveguide antennas are less expensive and are physically better suited to incorporation in relatively flat mounting configurations, but the signal pattern provided by waveguide antennas have certain limitations when mounted on a flat surface.

SUMMARY OF THE INVENTION

Briefly, in accordance with the invention, an antenna is provided for increasing the gain of, or shaping the pattern of, a radiated radio frequency signal. The antenna includes a waveguide for directing the radio frequency signal or for receiving directively the radio signal, a first conductive reflector disposed beneath the waveguide and extending beyond the aperture of the waveguide for reflecting certain of the waves emanating from or entering the aperture of the waveguide, and a second reflector, which may be the mounting surface, disposed beneath the first reflector and extending beyond the first reflector for reflecting other of the waves emanating from or entering the aperture of the waveguide.

BRIEF DESCRIPTION OF THE DRAWINGS

FIG. 1 shows the pattern of a signal from an open-end waveguide in free space.

FIG. 2 shows the pattern of a signal from an open-end waveguide mounted on a flat non-conductive surface.

FIG. 3 shows the pattern of a signal from an open-end waveguide mounted on a flat conductive surface.

FIG. 4 shows an antenna according to the invention, mounted to a flat conductive and non-conductive plate.

DETAILED DESCRIPTION OF A PREFERRED EMBODIMENT

FIG. 1 shows the pattern of a signal emanating from the open end 12 of a waveguide 10 in free space (for simplicity of description, hereafter references will be made to the transmission of a signal from the waveguide, it being understood that the same principles of gain and directivity apply to the receipt of signals by the waveguide antenna.) The coverage pattern would be approximately shown by the representation 14. It can be seen that the pattern 14 is relatively uniform both above and below the aperture 12 of the waveguide 10.

In an application where it is desired to elevate the signal from the free space pattern, and thereby to increase the gain of the antenna by providing some directivity to the radiated signal, the desired shape of the pattern would be from directly in front of the aperture 12 to above the horizon, that is, the pattern is desired to be elevated in E plain direction.

In a typical application of a waveguide radiator of this type, it is common to mount or place the waveguide antenna on a flat nonconductive surface, such as an automobile dashboard or a desk. In other applications, it may be desirable to mount the waveguide antenna on the ceiling of a room. This has the effect of elevating the pattern somewhat as shown in FIG. 2 because the rays 14 of the signal which form a small angle with respect to the nonconductive surface 16 are reflected upward, but short rays which have a high angle of attack with respect to the surface can penetrate that surface resulting in some loss of transmitted and received power.

One way to avoid the absorption loss is shown in FIG. 3. In this case the waveguide 10 is placed on a conductive plane such that the conductive plane extends below and in front of the aperture 12 of the waveguide. In this case the radiated or received waves which approach the conductive surface at a high angle of attack 20 as well as those which approach at a low angle of attack 18 are reflected such that the pattern is elevated to the desired shape. This is accomplished only by adding a large amount of conductive material (in the order of 8 to 12 inches or more for a signal above the GigaHertz range) to the design of the waveguide antenna. This increases the cost of the product and may not be practical in the product depending upon application and size constraints.

FIG. 4 shows an antenna according to the instant invention. In this case, the waveguide 10 is mounted on a short conductive plane 22 which extends a short distance in front of the aperture 12 of the waveguide 10. The waveguide 10 and the conductive plane 22 may then be mounted on a nonconductive surface or plane 16 as shown. In this case the radiated or received waves with a high angle of incidence to the surface of the planes are reflected effectively by the conductive plane 22, whereby those waves approaching the reflecting surface at a lower angle of attack are reflected by the nonconductive surface 16. This allows the performance of a large conductive plane to be realized without significantly increasing the size of the unit. Depending on the frequency of the transmission and the amount of elevation desired, the conductive area could be as small as a ½ inch in extension of the waveguide.

The invention may be used with any RF transmitter or receiver which operates in high frequency (microwave) ranges. The invention can be also used to customize the shape of the pattern to some extent by modifying the shape and length of the conductive area positioned in front of the waveguide aperture. So, for example if the conductive plane 22 of FIG. 4 were notched at the center of the plane immediately in front of the waveguide aperture, high angle waves travelling forward would be partially absorbed by the underlying conductive surface, but those emanating at an angle toward the side would be reflected. This would have the effect of elevating the side lobes of the pattern while not elevating the center.

We claim:

1. An antenna comprising:

a waveguide having an open end or aperture for fixing the direction of propagation of radio frequency waves radiating therefrom, a conductive generally planar surface disposed beneath and adjacent to said aperture and extending generally in said direction of propagation for a fixed distance beyond said aperture for reflecting radio frequency waves having a high angle of incidence relative to said conductive surface, and a non-conductive generally planar surface disposed beneath and adjacent to said conductive surface and extending generally in said direction of propagation beyond said conductive surface for reflecting radio frequency waves having a low angle of incidence relative to said non-conductive surface.

2. An antenna comprising:

waveguide means having an open end or aperture for fixing the direction of propagation of radio frequency waves radiating therefrom.

first surface means supporting said waveguide means and extending generally in said direction of propagation for a fixed distance beyond said aperture for reflecting radio frequency waves having a high angle of incidence relative to said first surface means, and second surface means supporting said first surface means and extending generally in said direction of propagation beyond said first means for reflecting radio frequency waves having a low angle of incidence relative to said second surface means, said surface means being conductive and generally planar.

3. The antenna of claim 2 wherein said second surface means is non-conductive and generally planar.

4. The antenna of claim 3 wherein said second surface means is a mounting surface, such as the ceiling of a room.

5. An antenna comprising:

waveguide means having an open end or aperture for fixing the direction of propagation of radio frequency waves emanating therefrom.

first surface means supporting said waveguide means and extending generally in said direction of propagation for a fixed distance beyond said aperture for reflecting short radio frequency waves, and second surface means supporting said first surface means and extending generally in said direction of propagation beyond said first surface means for reflecting long radio frequency waves.

said first surface means being conductive and generally planar.

6. The antenna of claim 5 wherein said second surface means is non-conductive and generally planar.

7. The antenna of claim 6 wherein said second surface means is a mounting surface, such as the ceiling of a room.

* * * * *

UNITED STATES PATENT AND TRADEMARK OFFICE

CERTIFICATE OF CORRECTION

PATENT NO. : 4,970,525

DATED : 11/13/90

INVENTOR(S) : Paul J. Rohret et al.

It is certified that error appears in the above-identified patent and that said Letters Patent is hereby corrected as shown below:

At column 3, line 29, "said first means" should be --said first surface means--.

At column 4, line 3, "said surface" should be --said first surface--.

Signed and Sealed this

Twenty-sixth Day of May, 1992

*Attest:*

DOUGLAS B. COMER

*Attesting Officer*

*Acting Commissioner of Patents and Trademarks*